US005097545A

United States Patent [19]

Hooi

[11] Patent Number: 5,097,545

[45] Date of Patent: Mar. 24, 1992

[54] SPRING SUPPORTED, HAMMOCK TYPE INFANT CRADLE

[76] Inventor: Ambrose C. S. Hooi, 124-128 Foster Road, Hillcrest, South Australia, Australia, 5086

[21] Appl. No.: 760,675

[22] Filed: Sep. 16, 1991

[51] Int. Cl.[5] ..... A47D 9/02; A45F 3/22; A45F 3/24

[52] U.S. Cl. ..... 5/104; 5/122; 5/123; 5/127; 297/274

[58] Field of Search ..... 5/104, 101, 122, 120, 5/123-130; 297/274, 275

[56] References Cited

U.S. PATENT DOCUMENTS

| | | | |
|---|---|---|---|
| 459,670 | 9/1891 | Barnhart | 5/104 |
| 505,797 | 9/1893 | Wastall | 5/128 |
| 558,792 | 4/1896 | Eschbach | 297/275 |
| 756,230 | 4/1904 | Goddard | 5/104 |
| 1,605,473 | 11/1926 | Schneidau | 5/104 |
| 1,613,657 | 1/1927 | Hawkins | 297/275 |

FOREIGN PATENT DOCUMENTS

| | | | |
|---|---|---|---|
| 61492 | 5/1913 | Austria | 5/104 |
| 1562135 | 3/1980 | United Kingdom | 5/104 |

*Primary Examiner*—Alexander Grosz
*Attorney, Agent, or Firm*—Townsend and Townsend

[57] ABSTRACT

An infant cradle comprising a support stand and a hammock that is suspended from the support stand. The support stand has a ground engaging base member, an upright member extending upwardly at an inclined angle in relation to the base member and a support member that extends away from the upright member. A spring is suspended from the support member, and in turn a hammock is suspended from the lower end of the spring. The hammock comprises a loop of sheet material which is gathered at the point where it is suspended from the spring. Second gathers are formed at either side of the spring, and the hammock is spread by a spreader bar that extends between the second gathers so as to hold the hammock open as it hangs from the spring. The upright member is inclined such that the hammock hangs substantially over the center of the base member.

7 Claims, 3 Drawing Sheets

SPRING SUPPORTED, HAMMOCK TYPE INFANT CRADLE

FIELD OF THE INVENTION

The present invention relates to an infant cradle, and in particular relates to a cradle comprising a hammock suspended from a frame.

BACKGROUND OF THE INVENTION

The most common form of cradle used for infants from birth is a bassinet style cradle. This comprises a flat base section with a surrounding wall, and a rectangular mattress is located on top of the base portion.

This provides a flat planar surface upon which the baby sleeps.

Obviously, young infants require a larger amount of sleep, but unfortunately some infants find sleeping somewhat difficult. It is felt that some infants do not cope with the transition from a mother's womb to sleeping in a totally different environment provided by a bassinet.

In the past, a great deal of effort has been expended in comforting infants at the early stages of their life while they are sleeping in such bassinets. Such arrangements include rocking, or providing rhythmic noises, which in some cases has quite beneficial effects.

SUMMARY OF THE INVENTION

It is therefore an object of the present invention to provide an infant cradle that is more suitable than existing bassinets, and which creates a better sleeping environment for young infants.

In its broadest form, the invention provides an infant cradle comprising the support stand having a ground engaging base member, an upright member extending upwardly at an inclined angle in relation to the base member, and a support member extending away from said upright member, a wire spring suspended from said support member, and a hammock suspended from the lower end of the spring, said hammock comprising a loop of sheet material, said loop being gathered at the point where it is suspended from said spring, and second gathers being formed at either side of said spring, and a spreader bar extending between said second gathers so as to hold the loop open as it hangs from said spring, said upright member being inclined such that said hammock hangs substantially over the centre of said base member.

Preferably, the support stand is manufactured using various segments of tubular material. For example, the base member may comprise a crosspiece having the ends of the crosspiece turned to 90° with respect to the crosspiece, and two side members, each of the side members having one end angled upwardly, the other end being swaged so as to engage the end pieces of the crosspiece so as to form a substantially U-shaped base member.

The upright member may comprise a pair of tubes having swaged ends for engagement with the upwardly angled ends of the side members, and the support member may comprise a substantially U-shaped tubular member having downwardly angled ends which engage the upper ends of the upright member. The upwardly angled ends of each side member are inclined so that the upright member and support member position the hammock substantially over the centre of the base member.

Preferably, the spring stiffness is selected so that the spring will not stretch when the hammock is suspended therefrom, but begins to stretch when any further or additional weight is placed into the hammock.

The spring preferably is provided with hooks at either end for connecting to support stand and hammock that are designed to prevent accidental disengagement. The hook may comprise a single loop of the spring wire that is generally in the vertical plane. However, the loop is formed into a spiral having a horizontal axis, with the end of the loop being spaced from the beginning so as to form an opening in the loop adjacent the respective end of the spring. In addition, the open end of the loop is closely spaced to the end of the spring. This prevents the hook from readily disengaging from the connection rings used on the support stand and hammock.

The hammock may further comprise a mattress placed within the hammock, and gussets may be formed in the edge of the hammock material at either end of the mattress. At the head end of the mattress, a gusset may be stitched at either corner of the mattress so as to form a cloth wall that extends across the head end of the mattress. In addition, a gauze panel may be inserted within the cloth extending between the gussets so as to provide a view of the infant.

At the foot end of the mattress, a single gusset is formed at the centre of the mattress, and preferably, buttons or snap fasteners are used so that the gusset can be opened and closed easily. This provides a large opening for placing a baby within the hammock, and allows this portion of the hammock to be closed to form a wall or barrier at the foot end of the mattress.

BRIEF DESCRIPTION OF THE DRAWINGS

The present invention will be more clearly understood and appreciated from the following detailed description taken in conjunction with the drawings in which.

DETAILED DESCRIPTION OF THE INVENTION

Figure 1:
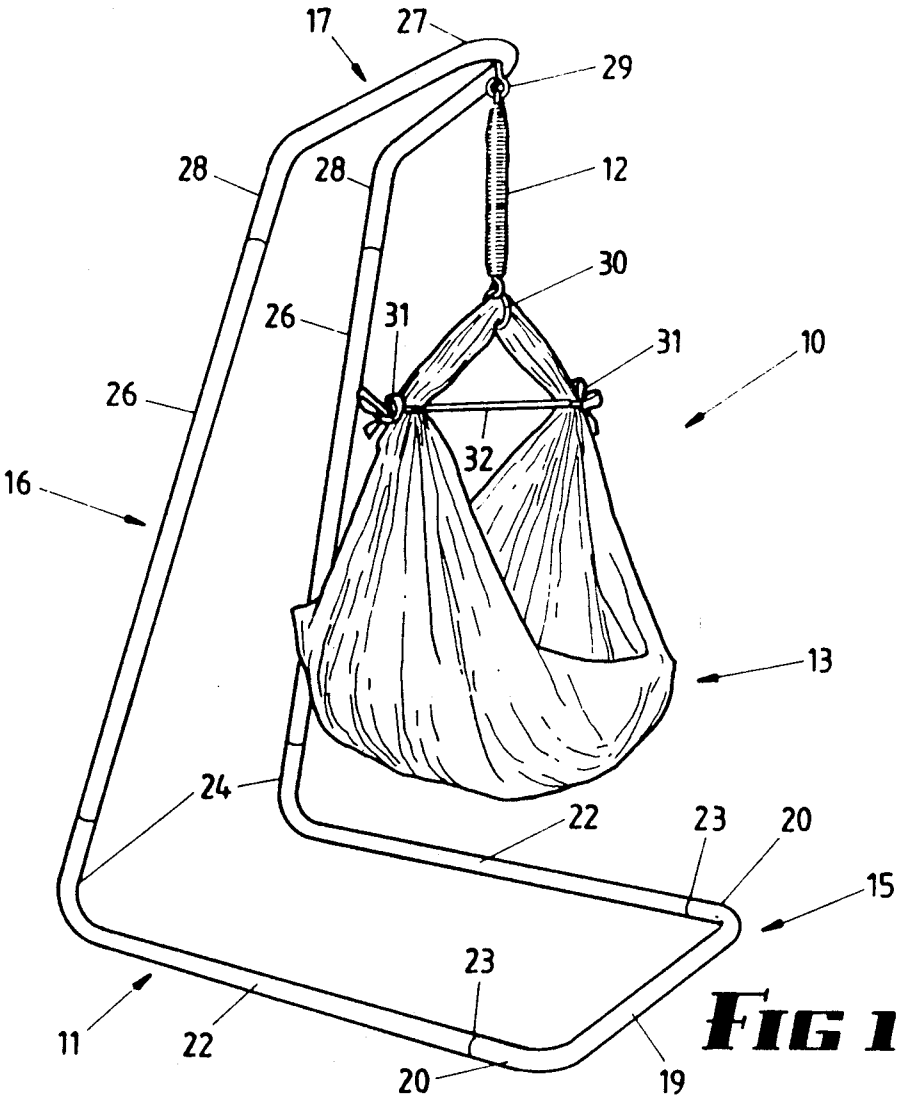
FIG. 1 shows a perspective view of the infant cradle in accordance with the invention.
Figure 2:
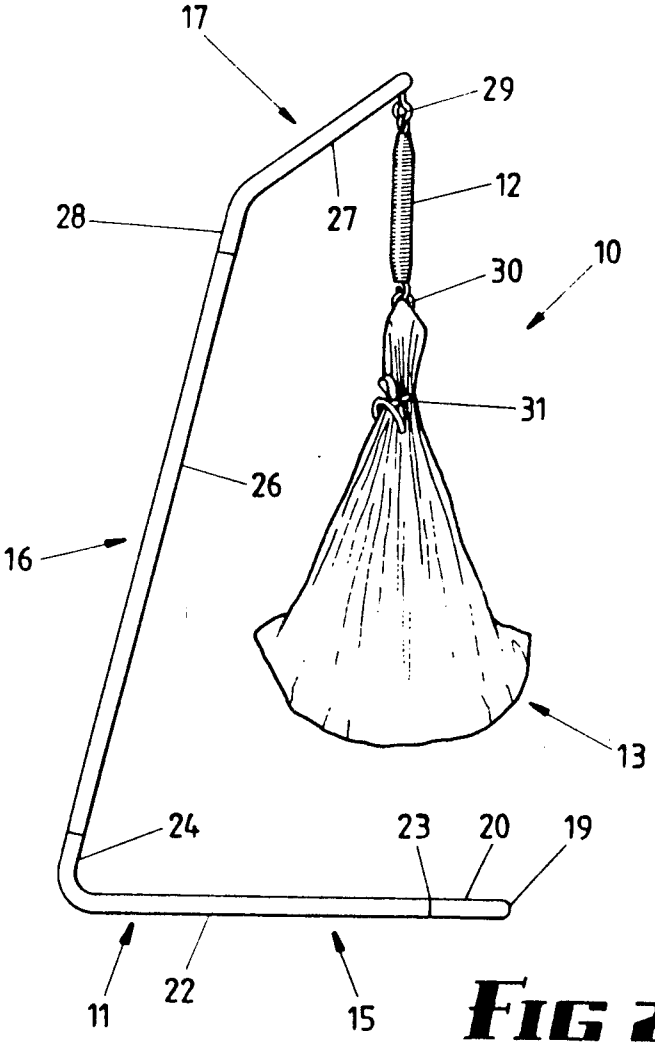
FIG. 2 shows a side view of the infant cradle in accordance with the invention.
Figure 3B:
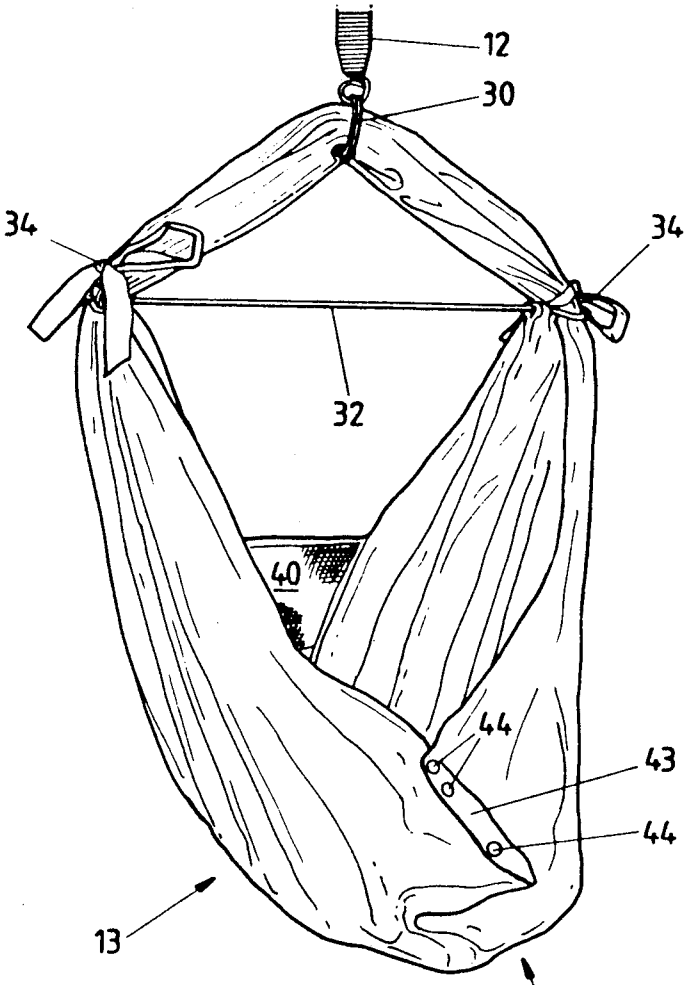
FIG. 3B shows a view of the hammock as seen from the feet end.
Figure 3A:
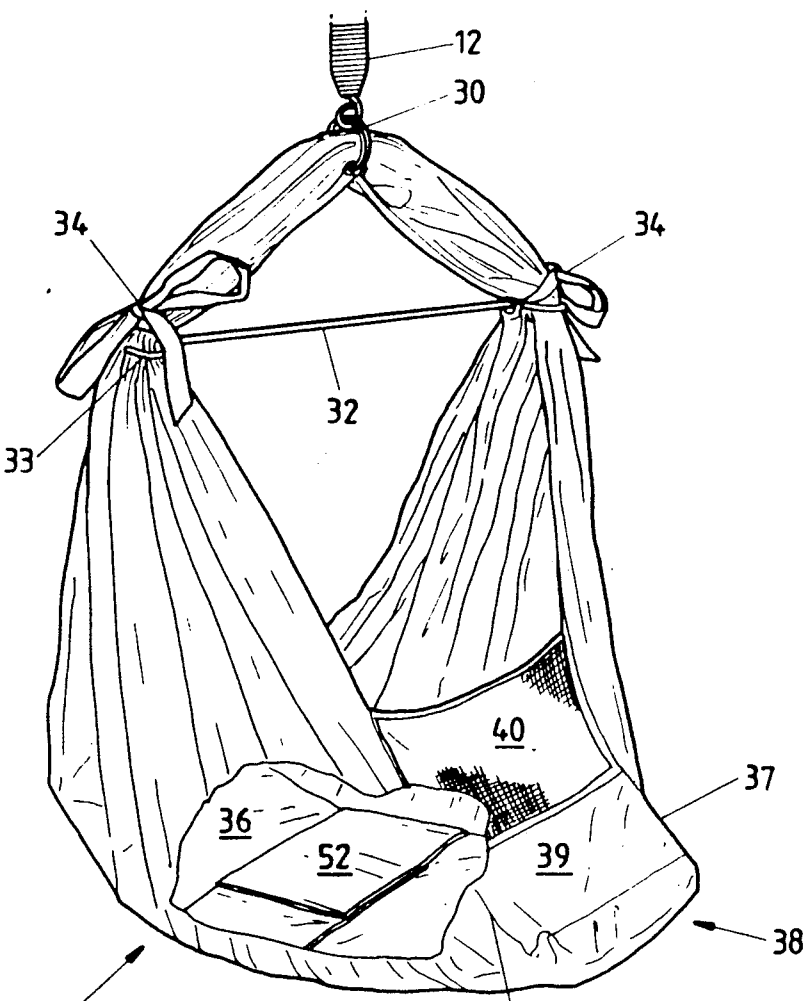
FIG. 3A shows a partially cutaway view of the hammock as seen from the head end.

In this embodiment, an infant cradle 10 comprises a support stand 11, a spring 12 and a hammock 13.

The support stand 11 comprises a base member 15, an upright member 16 and a support member 17.

The base member 15 comprises a crosspiece 19 having end pieces 20 that are turned to 90° with respect to the crosspiece. A pair of side members 22 have a swaged end 23 and an end 24 angled upwardly.

The swaged end 23 of each side member 22 engage each end piece 20 of the crosspiece 19. This forms a substantially U-shaped base member 15.

The upright member comprises a pair of tubes 26 and each end of the tube 26 is swaged. The tubes 26 are attached to the base member by engaging the ends 24 of the side members 22.

The support member comprises a substantially U-shaped tubular member 27 having downwardly angled ends 28. The ends 28 engage the swaged ends of the tubes 26.

The ends of each tubular member have aligning holes and threaded fasteners are used to secure the joints formed.

The ends 24 of the side members 22 are angled such that the upright member is inclined towards the centre of the base member 15 such that when the hammock 13 is suspended from the support member, it hangs substantially over the centre of the base member 15.

In this embodiment, the spring 12 is constructed from stainless steel, and its stiffness is selected such that the weight of the hammock 13 will not cause any extension of the spring. However, any additional weight placed into the hammock will cause extension of the spring 12.

An eyelet 29 on a shaft is secured to the support member 17. A vertical hole is drilled through the U-shaped tubular member 27, and the threaded shaft of the eyelet 29 is placed into the hole. A nut is placed on the threaded end so as to secure the eyelet 29 in place.

In this embodiment, the hammock 13 is formed from a strip of material, the ends of which are stitched together so as to form a closed, continuous loop. The width of the strip of material is sufficient to form the required length and height of the hammock.

At the uppermost point of the hammock, where it is attached to the spring 12, the loop of material is gathered together and held together by a ring 30. The ring 30 is attached to the lower end of the spring 12.

An additional two gathers 31 are formed either side of the ring 30. In order to hold the hammock apart at this point, a spreader bar 32 is inserted between the gather points 31. In this embodiment, the spreader bar 32 has an open loop 33 into which the hammock 13 is gathered. A tie 34 is attached to the hammock 13 adjacent to the gathers 31, and may be used to loop around the open loop 33 of the spreader bar 32, and tie around the gathers 31 so as to secure the gathers 31 and the spreader bar 32.

In order to complete the hammock 13, a mattress 36 may be inserted within the base of the hammock 13. However, it will be realised that the hammock 13 will be equally suitable for use without a mattress 36.

For additional security, gussets may be formed in the hammock 13 at each end of the mattress 36. In this embodiment, a pair of gussets 37 are formed in the head end 38 of the hammock 13 so as to form an upstanding cloth wall 39 across the head end 38 of the mattress 36. A gauze panel 40 is inserted in the hammock 13 at the head end 38 so as to provide a view into the hammock 13.

At the foot end 42 of hammock 13, a single gusset 43 is formed at the centre of the mattress 36. Snap fasteners 44 are used to secure the gusset 43 so that it can be opened and closed for placement of an infant into the hammock 13. The gusset 43 forms a barrier across the foot end 42 of the hammock 13 when closed.

Figure 4B:
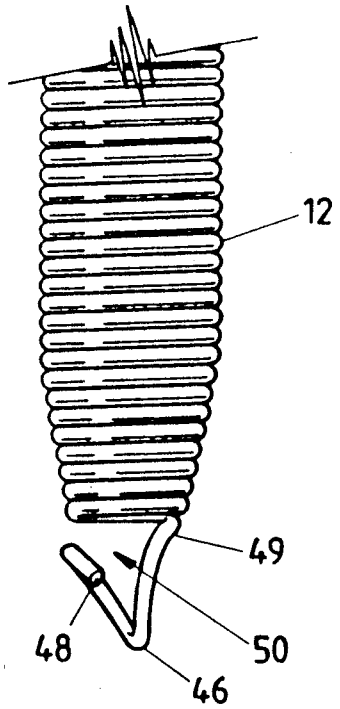
FIGS. 4A and 4B show details of the spring.
Figure 4A:
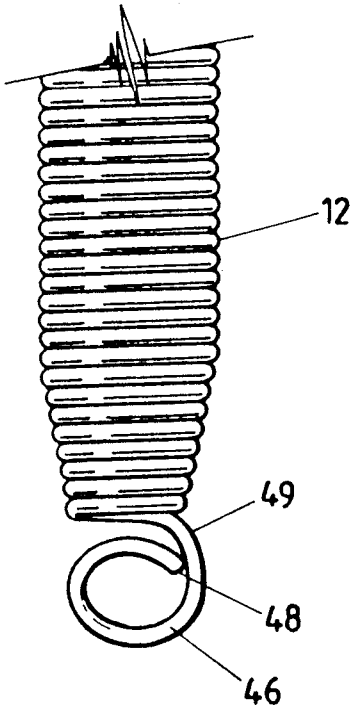
Figure 5:
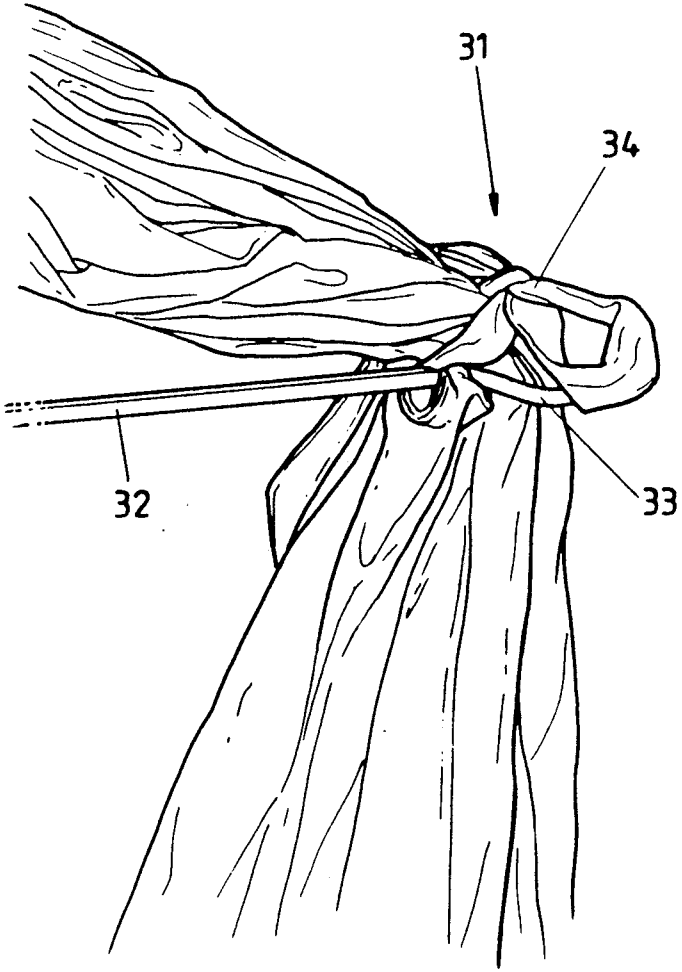
FIG. 5 shows detail of the hammock.

FIGS. 4A and 4B show the hook 46 used at either end of the spring 12. The hooks 46 are designed to prevent accidental disengagement of the hook 46 from the eyelet 29 or the ring 30. The hook 46 is essentially a single loop of the spring wire that is generally in the vertical plane. The hook 46 is however formed into a spiral form that has a horizontal axis, with the end of the loop 48 being spaced from the start of the loop 49 so as to form an opening 50 adjacent the respective ends of the spring 12. The opening 50 of the loop is closely spaced to the end of the spring 12. This design prevents the hook 46 from too readily disengaging from either the eyelet 29 of the ring 30.

It has been found that the physical contact offered by such a hammock and the effect of the enclosure produced by the hammock tend to make infants psychologically and physically happier and therefore resulting in more restful and lengthy sleep patterns.

The hammock in accordance with the invention creates the closeness and gentle rocking sensation of a mother's womb. In addition, it allows the infant to lie in a near fetal position which is more comfortable for the infant. In addition, the hammock which is manufactured from cotton material reduces uncomfortable pressure points on the infant's skin.

The hammock 13 may be used with or without the mattress 36, and particularly when the ambient temperature is high, the use of just the cloth hammock produces a more cooling effect. Further, the mattress 36 may be provided with a security belt 52 that has two portions for securing across the infant. Touch grip fastening material may be used at each end of the two portions. The belt 52 can comfortably and securely hold the infant on the mattress 36.

The construction of the hammock is such that it can be readily assembled or disassembled, thereby making the cradle transportable.

Further, the spreader bar 32 may be conveniently used for hanging toys or other items for the purpose of amusing the infant. In addition, a cord may be secured to the ring 30 that extends to the ground, and by forming a loop in the end of the cord, a person can place their foot into the loop so as to cause a rhythmic bouncing of the hammock 13.

As will be seen from the above description, the invention provides a novel and unique means of forming a cradle for an infant. Further, it has been found that infants benefit from using the hammock in that infants sleep more readily and generally sleep for longer periods. This is particularly so in relation to infants that are restless when using conventional bassinets.

What I claim is:

1. An infant cradle comprising a support stand having a ground engaging base member, an upright member extending upwardly in relation to the base member, and a support member extending away from said upright member, a wire spring suspended from said support member, and a hammock suspended from the lower end of the spring, said hammock comprising a closed, continuous loop of sheet material, said loop being gathered at the point where it is suspended from said spring, and second gathers being formed at either side of said spring, and a spreader bar extending between said second gathers so as to hold the loop open as it hangs from said spring, said upright member being inclined such that said hammock hangs substantially over the center of said base member.

2. An infant cradle according to claim 1 wherein said support stand comprises tubular material, and wherein said base member comprises a crosspiece having end pieces turned 90° with respect to the crosspiece, and two side members each having one end angled upwardly, the other end being swaged so as to engage the end pieces of said crosspiece to form a U-shaped base member, said upright member comprises a pair of tubes having swaged ends for engagement with the upwardly angled ends of said side members and said support member comprises a substantially U-shaped tubular member having downwardly angled ends each of which engage the upper ends of said upright member.

3. An infant cradle according to claim 1 wherein said spring further comprises a hook at each end of said spring, the hook being formed from a single complete loop of said spring wire that is substantially in a plane which is parallel to the longitudinal axis of said spring, the hook further being formed into a spiral having an axis normal to the longitudinal axis of said spring, and the end of said loop being spaced from the beginning of said loop so as to form an opening to said loop.

4. An infant cradle according to claim 3 wherein said spring has a stiffness that does not allow any stretching of said spring when said hammock is suspended from said spring, but stretches when any additional Weight is placed into said hammock.

5. An infant cradle according to claim 1 wherein said hammock further comprises a mattress placed within said hammock, and wherein a pair of gussets are formed in the edge of said hammock material adjacent each corner of said mattress at the head end of said mattress so as to form an upwardly extending cloth wall at said end of said mattress, and wherein a further gusset is formed in the edge of hammock material adjacent the middle of the foot end of said mattress, said further gusset being formed by releasably engageable fasteners, so as to form a barrier at the foot end of said mattress.

6. An infant cradle according to claim 5 wherein a gauze panel forms a portion of said cloth wall.

7. An infant cradle according to claim 5 further comprising a security belt secured to said mattress, said security belt comprising two cloth straps secured to either side of said mattress, and having releasable fastening means to secure the ends of said straps together.

* * * * *